US009140528B1

(12) United States Patent
Thomas et al.

(10) Patent No.: US 9,140,528 B1
(45) Date of Patent: Sep. 22, 2015

(54) COVERT TAGGANT DISPERSING GRENADE

(75) Inventors: Toby D. Thomas, Southlake, TX (US); Richard L. Green, Fort Worth, TX (US); Jonathan H. Record, Grand Prairie, TX (US); David L. Hunn, Kennedale, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 0 days.

(21) Appl. No.: 13/296,408

(22) Filed: Nov. 15, 2011

Related U.S. Application Data

(60) Provisional application No. 61/414,311, filed on Nov. 16, 2010.

(51) Int. Cl.
*F42B 12/36* (2006.01)
*F42B 12/50* (2006.01)

(52) U.S. Cl.
CPC ..... *F42B 12/36* (2013.01); *F42B 12/50* (2013.01)

(58) Field of Classification Search
USPC ..... 102/367–370, 502, 513, 334
See application file for complete search history.

(56) References Cited

U.S. PATENT DOCUMENTS

| | | | | |
|---|---|---|---|---|
| 2,821,924 | A | | 2/1958 | Hansen et al. |
| 3,283,719 | A | | 11/1966 | Grandy |
| 3,650,213 | A | | 3/1972 | Abbott et al. |
| 3,701,533 | A | | 10/1972 | Palmer |
| 3,802,345 | A | | 4/1974 | La Costa |
| 3,865,038 | A | | 2/1975 | Barr |
| 3,940,605 | A | | 2/1976 | Gerber |
| 3,954,060 | A | | 5/1976 | Haag et al. |
| 4,326,463 | A | | 4/1982 | Burke et al. |
| 4,455,943 | A | | 6/1984 | Pinson |
| 4,594,944 | A | | 6/1986 | Rongus |
| 4,619,202 | A | | 10/1986 | Romer et al. |
| 4,638,736 | A | | 1/1987 | Farmer |
| 4,638,737 | A | | 1/1987 | McIngvale |
| 4,706,568 | A | * | 11/1987 | Lundwall et al. ..... 102/513 |
| 4,777,882 | A | | 10/1988 | Dieval |
| 4,922,826 | A | | 5/1990 | Busch et al. |
| 4,957,046 | A | | 9/1990 | Puttock |
| 5,082,203 | A | | 1/1992 | Baubry |
| 5,119,715 | A | | 6/1992 | Porter, Jr. et al. |
| 5,221,809 | A | | 6/1993 | Cuadros |
| 5,635,667 | A | | 6/1997 | Boyer et al. |

(Continued)

FOREIGN PATENT DOCUMENTS

| | | | |
|---|---|---|---|
| FR | 2792399 | A1 | 10/2000 |
| WO | 2013053016 | A1 | 4/2013 |

OTHER PUBLICATIONS

Army Ammunition, 6-11 through 6-13.*

(Continued)

*Primary Examiner* — Troy Chambers
*Assistant Examiner* — Benjamin Gomberg
(74) *Attorney, Agent, or Firm* — Withrow & Terranova, PLLC

(57) ABSTRACT

A covert taggant dispersing grenade includes: a shell, the covert taggant disposed in the shell; a dispersal apparatus operably associated with the covert taggant to disperse the covert taggant; and a propulsion section operably associated with the shell for propelling the shell through an atmosphere. A method for dispersing a taggant includes: launching a grenade containing a taggant over a target, the taggant being invisible in the spectrum of the human eye; and covertly dispensing the taggant over the target.

12 Claims, 3 Drawing Sheets

(56) References Cited

U.S. PATENT DOCUMENTS

| | | | | |
|---|---|---|---|---|
| 5,654,524 | A * | 8/1997 | Saxby | 102/513 |
| 5,661,257 | A | 8/1997 | Nielson et al. | |
| 5,796,031 | A | 8/1998 | Sigler | |
| 5,817,969 | A | 10/1998 | Ettmuller | |
| 5,880,397 | A | 3/1999 | Crilly | |
| 6,142,056 | A | 11/2000 | Taleyarkhan | |
| 6,223,658 | B1 * | 5/2001 | Rosa et al. | 102/501 |
| 6,269,747 | B1 | 8/2001 | Strandli et al. | |
| 6,393,992 | B1 * | 5/2002 | Vasel et al. | 102/502 |
| 6,432,715 | B1 | 8/2002 | Nelson et al. | |
| 6,523,478 | B1 | 2/2003 | Gonzalez et al. | |
| 6,598,534 | B2 | 7/2003 | Lloyd et al. | |
| 6,688,032 | B1 | 2/2004 | Gonzalez et al. | |
| 6,843,179 | B2 | 1/2005 | Hunn et al. | |
| 6,871,594 | B1 * | 3/2005 | Estrella | 102/498 |
| 6,957,609 | B2 | 10/2005 | Ronn et al. | |
| 6,989,525 | B2 | 1/2006 | Howard | |
| 7,032,521 | B2 | 4/2006 | Ronn et al. | |
| 7,060,992 | B1 | 6/2006 | Barney | |
| 7,107,910 | B2 | 9/2006 | Hunn et al. | |
| 7,143,698 | B2 | 12/2006 | Lloyd | |
| 7,261,040 | B2 | 8/2007 | Hunn et al. | |
| 7,278,358 | B2 | 10/2007 | Huffman | |
| 7,380,503 | B2 * | 6/2008 | Williams et al. | 102/518 |
| 7,490,551 | B2 | 2/2009 | Golay et al. | |
| 7,530,315 | B2 | 5/2009 | Tepera et al. | |
| 7,600,475 | B1 | 10/2009 | Friedberg | |
| 7,743,709 | B2 | 6/2010 | Kolnik et al. | |
| 7,752,976 | B2 | 7/2010 | Banks | |
| 7,819,065 | B2 | 10/2010 | Haeselich | |
| 7,905,178 | B2 | 3/2011 | Dryer et al. | |
| 7,930,977 | B2 | 4/2011 | Klein | |
| 8,020,492 | B1 | 9/2011 | Kapeles | |
| 8,061,274 | B1 | 11/2011 | Hayes et al. | |
| 8,115,149 | B1 | 2/2012 | Manole et al. | |
| 8,196,514 | B2 | 6/2012 | Gustafsson et al. | |
| 8,240,252 | B2 | 8/2012 | Maljkovic et al. | |
| 8,281,720 | B2 | 10/2012 | Dindl et al. | |
| 8,286,557 | B2 | 10/2012 | Endicott et al. | |
| 8,387,538 | B2 | 3/2013 | Elder | |
| 8,415,598 | B1 | 4/2013 | Terhune et al. | |
| 8,464,639 | B2 | 6/2013 | Thomas et al. | |
| 8,511,231 | B2 | 8/2013 | Hayes et al. | |
| 8,616,127 | B2 | 12/2013 | Aliaghai et al. | |
| 8,661,981 | B2 | 3/2014 | Tepera et al. | |
| 8,708,285 | B1 | 4/2014 | Carreiro | |
| 2002/0174794 | A1 * | 11/2002 | Lowden et al. | 102/517 |
| 2005/0016412 | A1 * | 1/2005 | Vasel et al. | 102/502 |
| 2005/0188886 | A1 * | 9/2005 | Vasel et al. | 102/502 |
| 2007/0068414 | A1 | 3/2007 | O'Dwyer et al. | |
| 2009/0013893 | A1 | 1/2009 | Vasel et al. | |
| 2010/0000438 | A1 | 1/2010 | Dryer et al. | |
| 2010/0275807 | A1 * | 11/2010 | Landry et al. | 102/513 |
| 2011/0056402 | A1 | 3/2011 | Gustavsson et al. | |
| 2011/0067593 | A1 | 3/2011 | Klein | |
| 2011/0203475 | A1 | 8/2011 | Thuman | |
| 2011/0233426 | A1 | 9/2011 | Carroll et al. | |
| 2012/0006218 | A1 | 1/2012 | Dietrich | |
| 2012/0006219 | A1 | 1/2012 | Dietrich | |
| 2012/0180686 | A1 | 7/2012 | Jones et al. | |
| 2012/0227614 | A1 | 9/2012 | Sullivan | |
| 2013/0087063 | A1 | 4/2013 | Halter | |
| 2014/0025328 | A1 | 1/2014 | Burns et al. | |
| 2014/0041545 | A1 | 2/2014 | Aw et al. | |

OTHER PUBLICATIONS

Dr Anant Singh, TIAXX, LLC, Degradable Taggants & Automated Multi-platform Sensor for Intelligence, Surveillance and Reconnassaince.

Author Unknown, "Flight controlled Mortar (FCMortar)," Request for Information, Solicitation No. N0017813Q1010, Posted Mar. 27, 2013, Naval Surface Warfare Center, Dahlgren, Virginia, 7 pages.

Henderson, Milton E., Jr., "Fuze Efforts," AMRDEC, Weapons Development and Integration Directorate, Systems & Warheads Function, (RDMR-WDP-S), May 7, 2012, Control # FN5850, 15 pages.

Sandia National Laboratories et al., "Variable Range Less-Than-Lethal Ballistics," Final Report to the National Institute of Justice on Grant No. 2000-LT-BX-K004, Document No. 199046, U.S. Department of Justice, Jan. 2003, 66 pages.

Non-Final Office Action for U.S. Appl. No. 12/914,803, mailed Aug. 29, 2014, 11 pages.

Notice of Allowance for U.S. Appl. No. 12/914,803, mailed Jan. 6, 2015, 7 pages.

Non-Final Office Action for U.S. Appl. No. 14/198,721, mailed Feb. 26, 2015, 8 pages.

Singh, Anant, "Degradable Taggants & Automated Multi-platform Sensor for Intelligence, Surveillance and Reconnassaince," Narrative Briefing, Command: ONR—SBIR, Topic: N07-072, TIAX LLC, Jun. 2010, Lexington, Massachusetts, 6 pages.

Non-Final Office Action for U.S. Appl. No. 14/198,732, mailed May 6, 2015, 14 pages.

Notice of Allowance for U.S. Appl. No. 14/198,721, mailed Jul. 31, 2015, 9 pages.

* cited by examiner

COVERT TAGGANT DISPERSING GRENADE

CROSS-REFERENCE TO RELATED APPLICATIONS

The priority of U.S. Provisional Application Ser. No. 61/414,311, entitled "Covert Taggant Dispersing Grenade", filed Nov. 16, 2010, in the name of the inventors Toby D. Thomas et al. is hereby claimed pursuant to 35 U.S.C. §119 (e). This application is also hereby incorporated by reference for all purposes as if set forth herein verbatim.

The following U.S. patents and patent applications are also hereby incorporated by reference for all purposes as if set forth verbatim herein:

- U.S. patent application Ser. No. 12/914,803; entitled "Rocket-Propelled Grenade", filed Oct. 28, 2010, in the name of the inventors Toby D. Thomas et al. and commonly assigned herewith;
- U.S. Patent Application Ser. No. 61/256,258, entitled "Grenade", filed Oct. 29, 2009, and commonly assigned herewith.

STATEMENT REGARDING FEDERALLY SPONSORED RESEARCH OR DEVELOPMENT

Not applicable.

BACKGROUND

This section of this document introduces various concepts of the art that may provide context or be related to various aspects of the present invention described and/or claimed below. It provides background information to facilitate a better understanding of the various aspects of the present invention. As the section's title implies, this is a background discussion of "related" art. That such art is related in no way implies that it is also "prior" art. The related art may or may not be prior art. The discussion in this section of this document is to be read in this light, and not as admissions of prior art.

In military or police crowd control situations, particularly in riot or violent confrontations with large numbers of people it is often desirable but not practical to identify all participants. The mob members will disperse unless physically restrained and it is not possible to easily identify a person at a later time as having been involved in the act. In some situations it is desirable to covertly mark subjects with a material which will allow them to be later identified.

The present invention is directed to resolving, or at least reducing, one or all of the problems mentioned above.

SUMMARY

The present invention includes among its many aspects a covert taggant dispersing grenade and a method for dispersing a taggant. The grenade comprises: a shell, the covert taggant disposed in the shell; a dispersal apparatus operably associated with the covert taggant to disperse the covert taggant; and a propulsion section operably associated with the shell for propelling the shell through an atmosphere. The method includes: launching a grenade containing a taggant over a target, the taggant being invisible in the spectrum of the human eye; and covertly dispensing the taggant over the target.

The above presents a simplified summary of the invention as claimed below in order to provide a basic understanding of some aspects thereof. This summary is not an exhaustive overview. It is not intended to identify key or critical elements or to delineate the scope of the invention. Its sole purpose is to present some concepts in a simplified form as a prelude to the more detailed description set forth below.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The present invention provides a technique by which people, vehicles and other objects on the ground may be tagged by an airborne taggant dispersal grenade. This includes a dispersal system housed in a grenade which can be fired over, for example, a group of individuals. This particular solution does not use a grenade which explodes with a loud report and flash, but uses a device which will disperse the taggant with little or no audible noise of visible flash. This will reduces the probability that the individuals being marked will be aware of being marked. It also employs a taggant not visible to the human eye but that fluoresces when exposed to radiation of a predetermined wavelength.

Figure 1:
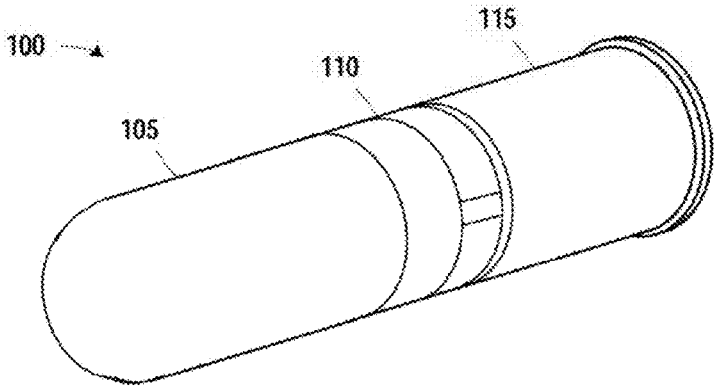
FIG. 1 is a perspective view of one particular embodiment of a grenade.

FIG. 1 is a perspective view of one particular embodiment of a grenade 100. The grenade 100 comprises a shell 105 in which a taggant (not shown) is stored. As will be discussed further below, the technique admits wide latitude in the design and implementation of the shell 105 and the taggant. It also includes a dispersal apparatus 110 and a propulsion section 115. The dispersal apparatus 110 is operably associated with the taggant to disperse it in a manner discussed more fully below. The propulsion section 115 is operably associated with the shell 105 for propelling the shell 105 through an atmosphere.

The grenade 100 may come in any suitable caliber known to the art. For example, the United States military uses 40 mm grenades and United States law enforcement agencies typically use 37 mm grenades. The grenade 100 is designed for deployment using existing grenade launchers. The United States military uses, for example, M203, M320, and Mk 19 grenade launchers. The M203 and M320 are rail mounted to rifles while the Mk 19 is a belt-fed automatic grenade launcher. However, it is not material to the practice of the technique that the caliber be one currently in use or that it be compatible with existing launchers.

As those in the art will appreciate, the ammunition for the M203 and M320 is not interchangeable with that of the Mk 19. Thus, the launcher with which the grenade 100 is to be used will influence the design and implementation of the grenade 100. However, these implementation specific details will be readily recognized by those in the art having the benefit of this disclosure and are not material to the practice of the technique.

Suitable taggants are already known to the art and many are commercially available. These include, for example, radio frequency ("RF") detectable particles, radioactive emission detectable particles, and visual wavelength detectable particles/dyes, and clear UV fluorescent dyes. The selection of the taggant in any given embodiment will be driven by implementation specific considerations.

In one embodiment, taggant is a generally transparent, permanent dye that fluoresces when exposed to ultraviolet light. The taggant may comprise, for example, triazinyl stilbene-based invisible ink, such as triazinyl stilbene-based blue invisible ink. Commercially available dyes suitable for this purpose include a type DFSB-C7 clear red fluorescent solvent-based dye, type DFWBOK412-50 clear blue fluorescent dye, type IF2-C2 clear yellow fluorescent ink, or IF2C6 clear green fluorescent ink, each provided by Risk Reactor of Dallas, Oreg., US. Furthermore, taggant may include Tracerline clear blue fluorescent dye, such as type TP-3920 fluorescent dye, provided by Tracer Products of Westbury, N.Y., US. In other embodiments, taggant may include series T-800 or T-900 water-based tracer, provided by Black Light World of Cub Run, Ky., U.S.

However, the taggant is not limited to dyes. In some embodiments, the taggant may be what are known in the art as "quantum dots" or "nano-crystals". Quantum dots are very small semiconductor devices—sufficiently small that they are frequently classed as a nano-technology. These are readily commercially available because of their increasing use in medical applications. Exemplary quantum dot providers include QD Vision, Inc., of 29 Hartwell Ave., Lexington, Mass. 02421, ph: (781) 652-7400, and Voxtel, Inc. of 15985 NW Schendel Ave., #200, Beaverton, Oreg. 97006, ph: 971-223-5646, fax: 503-296-2862. Many other quantum dot providers offer products suitable for use as described herein.

In some embodiments, it is desirable that the taggant's signature degrade or decay over time so as not to leave a permanent signature. This is one advantage of the quantum dots, the lifetime of whose signatures can be engineered. The lifetime of their fluorescence is a function of well known factors such as their size. Quantum dot providers can also provide this type of engineering as one of their services.

It is also desirable in some embodiments that the taggant be applied covertly. One aspect of this concern is that the taggant should not be readily visible under ambient conditions. This is a common feature of many taggants, which frequently are invisible under ambient conditions but fluorescence in the presence of incident energy of a certain frequency. Suitable taggants for this purpose include, for example, both dyes and quantum dots. However, the signature decay that quantum dots possess furthers the covert nature of many embodiments by reducing the risk of inadvertent detection by those that have been tagged or their compatriots.

As is apparent from the discussion above, the taggant may be either a liquid or a powder. This distinction influences to some degree the implementation of other aspects of the grenade. To illustrate how this might be the case, FIG. 2A-FIG. 2C depict an embodiment in which the taggant is a liquid while FIG. 3A-FIG. 3C depict a powdered taggant embodiment.

Figure 2A:
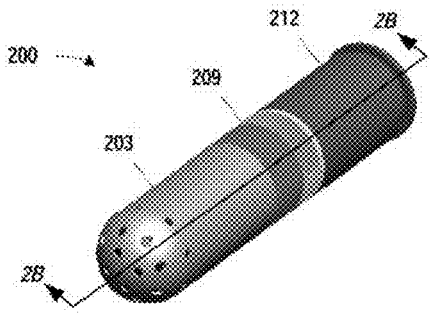
FIG. 2A-2C and FIG. 3A-3C illustrate two particular, alternative variants of the grenade shown in FIG. 1.
Figure 2B:
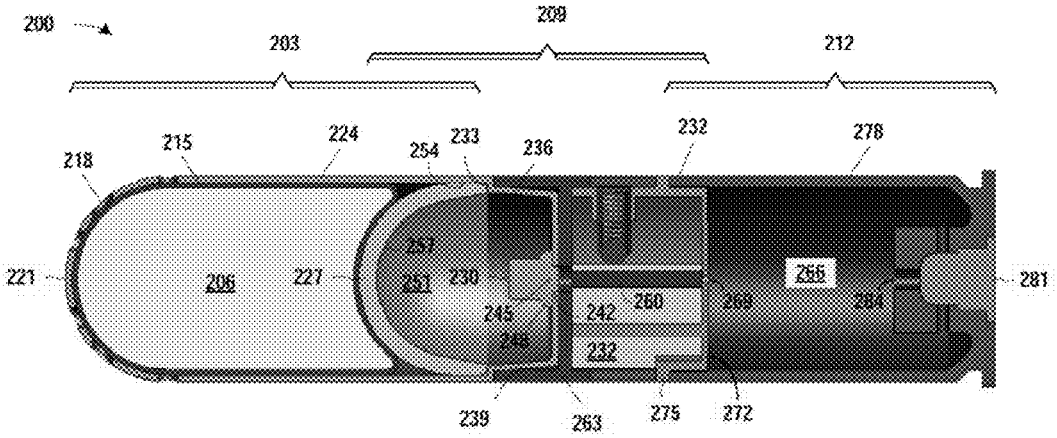
Figure 2C:
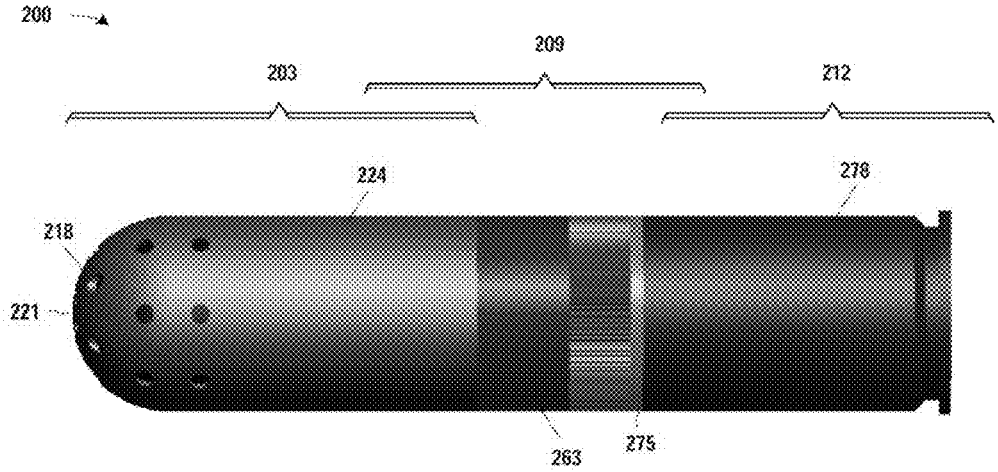
Figure 3A:
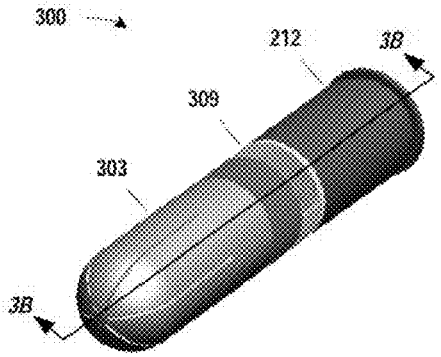
Figure 3B:
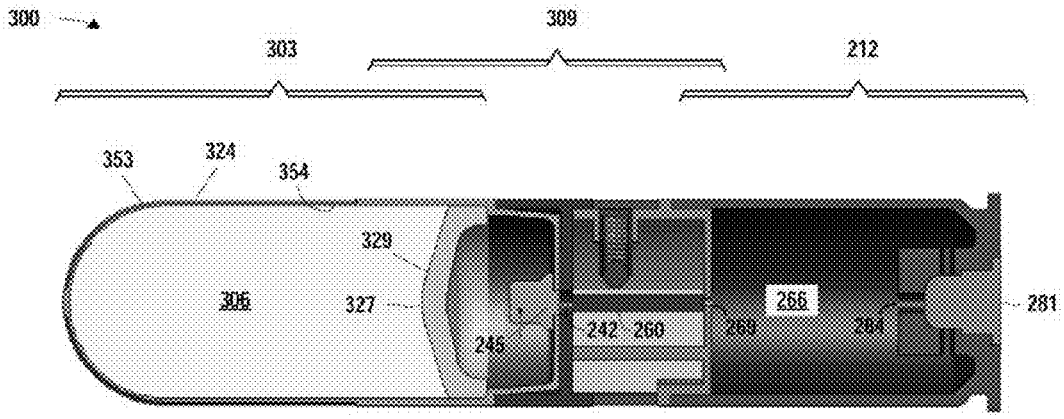
Figure 3C:
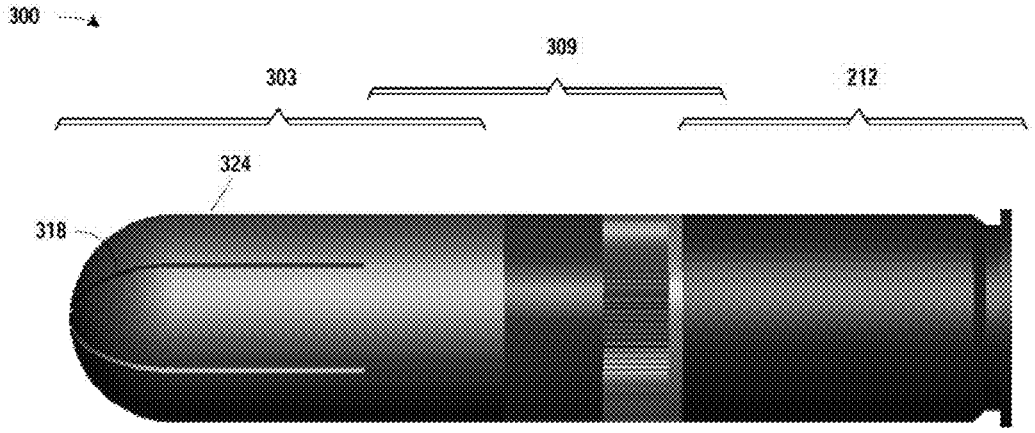

Turning now to FIG. 2A-FIG. 2C, these drawings depict one particular embodiment of a grenade 200. FIG. 2A is a perspective, elevational view of the grenade 200, FIG. 2B is a sectioned view along line 2B-2B in FIG. 2A, and FIG. 2C is a plan, side view of the grenade 200 from the same direction as the sectioned view of FIG. 2B. The grenade 200 comprises a shell 203 in which the taggant 206 is disposed, a dispersal apparatus 209, and a propulsion section 212. The dispersal apparatus 209 is operably associated with the taggant 206 to disperse it. The propulsion section 212 is operably associated with the shell 203 for propelling the shell 203 through an atmosphere.

More particularly, the taggant 206 is a liquid disposed within a bladder 215 fabricated from an elastomeric material. The taggant 206 is, in this particular embodiment, a "covert" taggant that degrades over time such as is described above. The taggant 206 is dispersed when the dispersal apparatus 209 actuates and overpressures the taggant 206 to the point where the bladder 215 bursts. Once the bladder 215 bursts, the taggant 206 is forced through the apertures 218 (only one indicated) in the forward end 221 of the nose cone 224.

The dispersal apparatus 209 principally comprises a dome-shaped piston 227, a pyrotechnic charge 230, and a fusing mechanism 232. When assembled, the piston 227 seats on a shoulder 233 defined by a cup 236 formed in the tail end 239 of the nose cone 224. The pyrotechnic charge 230 is seated on an opening 242 in the floor of the cup 236 into which a stem 245 extending from the skirt 248 thereof fits. The pyrotechnic charge 230 may be implemented using any suitable firing charge known to the art. Exemplary pyrotechnic charges 230 include, but are not limited to, a Federal 215 percussion primer and an M2 firing charge, such as used in the U.S. M430A1 40 mm grenade, or the like. However, other firing charges are known to the art and may be used.

The dome-shaped piston 227 and the cup 236 define a pressure chamber 251. The pressure chamber 251 are sealed by a friction fit between piston 227 and the interior surface 254 of the nose cone 224. The skirt 248 of the pyrotechnic charge 230 seals the opening 242 when the pyrotechnic charge 230 is ignited. When the pyrotechnic charge 230 ignites, it fills the pressure chamber 251 with rapidly expanding gasses that exert a pressure against the interior face 257 of the piston 227 and the skirt 248 of the pyrotechnic charge 230. The pressure against the interior face 257 of the piston 227 builds to overcome the previously mentioned friction fit and urges the piston 227 forward. As it moves forward, the piston 227 then overpressures the taggant 206 to burst the bladder 215 and disburse the taggant 206.

The pyrotechnic charge 230 is ignited by the fusing mechanism 232. The structure and operation of the fusing mechanism 230 is more thoroughly illustrated and explained in U.S. patent application Ser. No. 12/914,803. This application is incorporated by reference above. For present purposes, the fusing mechanism 232 can be manually rotated by a grenadier to select one of a plurality of fuses 260 (only one indicated), each having a different burn time. The fusing mechanism therefore provides a mechanical timing mechanism for the grenade 200. The selected fuse 260 is exposed to the pyrotechnic charge 230 through the opening 242. The fusing mechanism 230 is otherwise isolated from the tail end 239 of the nose cone 224 forward by a cover 263. The selected fuse 260 is exposed to a launch pressure chamber 266 in the propulsion section 212 through a passageway 269 through the end wall 272 of a housing 275 of the fusing mechanism 232.

The fuses 260 are, in the illustrated embodiments, what are known as "pyrotechnic fuses". Pyrotechnic fuses are commonly made of compounds of sulfur, silicon, tungsten, and boron. Pyrotechnic delays are used to control the time of events from the initiation of an initial impulse to the initiation of a secondary impulse, or output. Typically the delay is initiated by a thermal energy input. Timing is achieved by the linear reaction rate of a column of the pyrotechnic.

Micron or Nano-sized aluminum and/or boron particles can be utilized to control the burning rate and impetus of the functionally graded propellants ("FGPs"). Due to the formulation variation in specific directions, the combustion/mechanical behavior of a given FGP is also a function of the distance perpendicular to the burning surface. Desired burn rate control can be achieved by variations in propellant composition and particle size distribution. For example, by introducing different amounts and shapes of aluminum particles (e.g. micron aluminum flake vs. nano-sized aluminum rods vs. nano-sized spherical aluminum particles), the burning rate of the propellant could vary by several hundred percent.

The propulsion section 212 comprises a casing 278 affixed to the housing 275 and a primer 281 centered in the tail end of the casing 278. The casing 278 defines one or more ports 284 (only one indicated) extending from the positioned primer 281. The ports 281 direct rapidly expanding gasses from the ignited firing charge 201 into the pressure chamber 266. The primer 281 may be implemented using any suitable primer known to the art. Exemplary primers 281 include, but are not limited to, a FED215 percussion primer, or a 38 Smith & Wesson blank cartridge. However, other primers are known to the art and may be used.

When the primer 281 is initiated, these rapidly expanding gases separate the casing 278 from the housing 275, whereupon the dispersal apparatus 209 and the shell 203 are propelled from the launcher and through the air. The heat generated by the initiated primer 281 propagates through passageway 269 in the housing 275 to initiate the selected fuse 260. The selected fuse 260 is consumed over a period of time and, when fully consumed or about fully consumed, heat is propagated from the fuse 260 through passageway 242 through the cover 263 and the cup 239 to activate the pyrotechnic charge 230. The pyrotechnic charge 230 that acts as described above to effect the dispersal of the taggant 206.

Turning now to FIG. 3A-FIG. 3C, these drawings depict one particular embodiment of a grenade 300. FIG. 3A is a perspective, elevational view of the grenade 300, FIG. 3B is a sectioned view along line 3B-3B in FIG. 3A, and FIG. 3C is a plan, side view of the grenade 300 from the same direction as the sectioned view of FIG. 3B. The embodiments of FIG. 2A-FIG. 2C and FIG. 3A-3C share common pyrotechnic charges 230, fusing mechanisms 232 and propulsion sections 212. To avoid repetition and so as not to obscure the present invention, these common elements will not be described again, it being understood that the discussion above relative to the embodiment of FIG. 2A-FIG. 2C pertains equally here. Like numbers are used to designate like parts in FIG. 2A-FIG. 2C and FIG. 3A-FIG. 3C to facilitate this understanding.

The shell 303 of the grenade 300 differs from its counterpart in the previous embodiment in two respects. First, the taggant 306 is a powder rather than a liquid. This means the bladder 215 containing the liquid taggant 206, shown in FIG. 2B, can be omitted if desired. This is the case in the embodiment illustrated in FIG. 3A-FIG. 3C. Second, the apertures 218 have been replaced by scores 318 (only one indicated) shown best in FIG. 3C. The scores 318 intentionally compromise the structural integrity of the nose cone 324 in a predetermined manner by virtue of their placement, depth, and extent.

The dispersal apparatus 309 also differs from its counterpart in the previous embodiment in two respects. The first difference is in the design of the piston 327. Rather than being hemi-spherical, the forward face 329 of the piston 327 is merely arced. The second way it differs is in its operation. When the pyrotechnic charge 245 ignites to urge the piston 327 forward, it still overpressures the taggant 306. However, the overpressure has a different effect. The overpressure builds until the structural integrity of the nose cone 325 fails long the scores 318. Note that this failure in structural integrity is both desired and intentional. The powdered taggant 306 then spills from the nose cone 325 as it is pushed out by the piston 327.

The apertures 218 in the grenade 200 of FIG. 2A-FIG. 2C and the scores 318 in the grenade 300 of FIG. 3A-3C determine the dispersal pattern of the taggants 206, 306, respectively. They are, by way of example and illustration, but two different means for determining the dispersal pattern for the taggants 206, 306. Alternative embodiments may employ other mechanisms of equivalent structure that perform that function. For example, the apertures 218 might not be circular or elliptical in their geometry, but rather square or rectangular. The scores 318 are shown on the exterior surface 353 of the nose cone 325 but can be formed on the interior surface 354 instead. Still other approaches might be used in other alternative embodiments. The grenade 100 in FIG. 1 contains no such means, and so its dispersal pattern will be unpredictable.

The embodiments illustrated in FIG. 2A-FIG. 2C and in FIG. 3A-3C use the same selectable, variable fusing mechanism. However, the technique admits variation in the fusing and so this is not required for the practice of the technique. The variable fusing mechanism disclosed above is, by way of example and illustration, but one means for actuating the dispersal mechanism 110. Alternative embodiments may employ other mechanisms of equivalent structure that perform that function. Some alternative embodiments may even employ conventional fuses having a single burn rate.

The technique also admits variation in the design and implementation of the propulsion section 115. While both of the embodiments in in FIG. 2A-FIG. 2C and in FIG. 3A-3C share a common design, this is not necessary to the practice of the technique. There are a number of propulsion techniques known to the art for launching grenades, any of which that are suitable may be employed in alternative embodiments.

Figure 4:
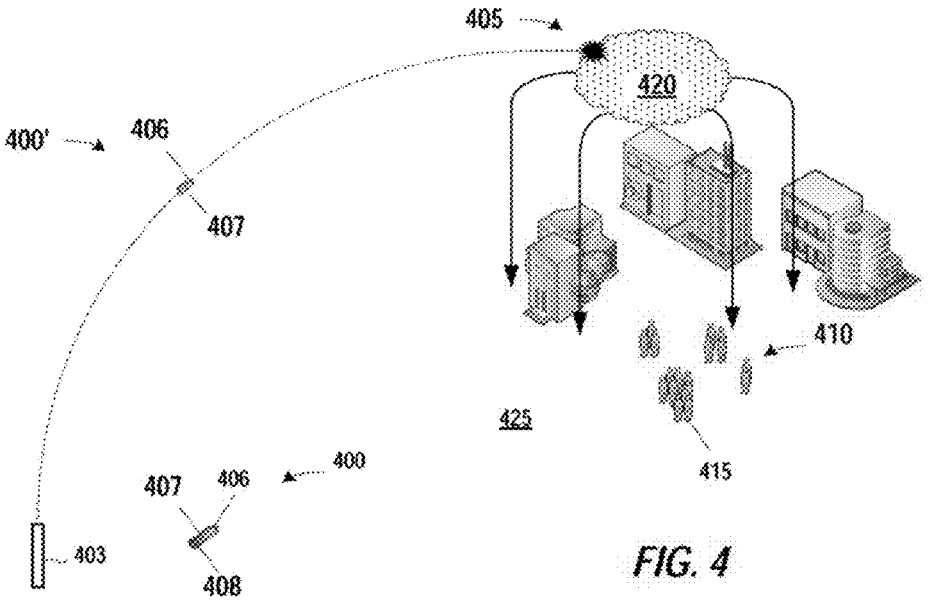
FIG. 4 illustrates the deployment of a grenade to target to covertly tag members of a group of people in accordance with one aspect of the presently disclosed technique.

Turning now to FIG. 4, the grenade 400 is propelled from a launcher 403 when the launcher 403 is fired by the propulsion section 408 of the grenade 400 as described above. The grenade 400 is launched toward a spot 405 above a group 410 of people 415 (only one indicated). The launch typically generates only low levels of sound and generally occurs at some distance from the target. It is therefore difficult for the group 410 to hear and may easily be masked by environmental conditions such as wind and/or the activities of the group 410 or others in their vicinity.

The spot 405 is selected by the grenadier based on available fuse length, distance from the group 410, and environmental conditions such as wind and relative altitude. The grenade 400 (represented as the grenade 400' in flight) comprises only the dispersal apparatus 407 and the shell 406 in flight. Those in the art having the benefit of this disclosure will appreciate that the spot 405 may vary from the spot actually chosen by the grenadier due to factors such as uneven fuse burn times, wind, or even miscalculation. Such variations are, however, immaterial to the present discussion.

The dispersal apparatus 407 then disperses the taggant 420 when set off by the fuse as described above. The pyrotechnic charge that overpressures the nose cone can be relatively small given its function. It therefore also generates relatively low levels of sound that will again be difficult for the group 410 to hear. The flash is similarly low, and largely contained by the dispersal apparatus 407. The taggant 420 is, in this embodiment, the quantum dots previously mentioned. They are not, in themselves, visible under ambient lighting conditions. Thus, even if someone in the group 410 notices the dispersal it is unlikely they will appreciate what is happening.

The taggant 420 will then drift to the ground 425 as represented by the arrows 430 (only one indicated). The pattern of the dispersal, which greatly influences the pattern of the drift, is determined by nose cone design as discussed above. The fallen taggant 420 adheres as it contacts various surfaces, including the skin, hair, and clothing of the people 415. This is the "tagging" of the people 415, who in this embodiment are the target of the tagging effort. Note, however, that the tagging is not limited to the people 415. This includes other things one might want to track such as vehicles. In some embodiments, the vehicles and other mobile or moveable object might be targets in addition to or in lieu of the people 415. The tagging may also include things one might not wish to track, including buildings, other fixtures, and the ground itself. This is one reason that decay over time is desirable in some embodiments. Conversely, it may be undesirable in others if the decay finishes before one is through using the tag.

Because the taggant 420 is invisible under ambient lighting conditions, the tagged people 415 remain unaware of its presence. The taggant 420 will nevertheless fluoresce when exposed to light of the proper wavelength. The fluorescent frequencies of quantum dot taggants are known at the time of manufacture. Many quantum dot providers also offer detectors that will radiate light of the proper frequency to fluoresce the taggant. Tagged individuals and objects can then be readily identified.

While any fluorescent wavelength outside the visible spectrum for humans will perform satisfactorily, some promote the covert nature of this particular embodiment better than others. For example, infrared ("IR") will perform adequately by IR detectors are pervasive and so inadvertent detection would be more likely. Near IR ("NIR") technology is not so pervasive, but its radiation can be detected as heat energy by individuals on whom it is turned. Some embodiments may nevertheless employ such wavelengths. The illustrated embodiments use ultraviolet ("UV") wavelengths.

The present invention in the illustrated embodiments therefore presents a rocket-propelled or otherwise launchable grenade configured to disperse a covert taggant material over one or more persons, so that the persons may be identified at a later time. In one embodiment, the covert taggant material is visible when illuminated by light exhibiting one or more wavelengths outside the human-visible spectrum. The covert taggant dispersing grenade comprises, in one embodiment, a shell in which the covert taggant is disposed, a dispersal apparatus operably associated with the covert taggant to disperse the covert taggant, and a propulsion section operably associated with the shell for propelling the shell through an atmosphere. The covert taggant, for example, may be in liquid or powder form. The shell defines one or more features that allow the taggant to be dispersed therefrom, such as openings, a scored burst pattern, or the like. In one embodiment, the dispersal apparatus comprises an energetic charge and a dispersal piston operably associated with the covert taggant and the energetic charge. A fuse, such as a selectable fuse apparatus, may be operatively associated with the energetic charge. In one embodiment, the selectable fuse apparatus comprises a selector cam housing a plurality of fuses. The selector cam is positionable such that one of the plurality of fuses is operatively associated with the energetic charge.

This grenade with its dispersal system uses covert methods to tag and track individuals without alerting them. Individuals can be identified at a later time and place by use of a chemical tagging and detection system to assist the warfighter in finding and tracking insurgents after they have fled from an engagement. The combination of a distinctive pattern, reflective at the appropriate wavelength and photograph provide evidence of positive identification. A gas generator driving a piston creates the force necessary to drive the taggant from the grenade as it passes over the individuals being marked. By using a grenade filler taggant, a grenade can be constructed that provides a less-than-lethal method of marking the participants of a large group of individuals. A manually selectable switch will provide a short, medium, or long delay before discharge allowing the user to choose the range from himself that the taggant is dispersed.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for dispersing a taggant in an atmosphere prior to an impact, comprising:

launching, over a target, a grenade comprising:

a pyrotechnic charge; and a bladder containing the taggant and disposed within a shell, the bladder separating the taggant from the pyrotechnic charge, the taggant being invisible to a human eye under ambient lighting conditions;

receiving, prior to launching the grenade over the target, a selection of a particular fuse of a plurality of fuses located within the grenade, each fuse of the plurality of fuses having a different burn time; and activating the pyrotechnic charge to cause overpressure of the taggant to burst the bladder in the atmosphere over the target, thereby dispersing the taggant over the target.

2. The method of claim 1, wherein the taggant fluoresces at ultraviolet wavelengths.

3. The method of claim 1, wherein a signature of the taggant decays over time.

4. The method of claim 1, wherein dispersing the taggant includes dispersing the taggant in a predetermined pattern.

5. The method of claim 1, wherein the shell further comprises:

a nose cone comprising a plurality of apertures, wherein the taggant is forced through the plurality of apertures when the bladder bursts.

6. The method of claim 1, wherein the bladder comprises an elastomeric material.

7. A method for dispersing in an atmosphere a taggant over a target, comprising:

receiving, prior to launching a dispersing grenade over the target, a selection of a particular fuse of a plurality of fuses located within the grenade, each fuse of the plurality of fuses having a different burn time;

activating, by the particular fuse in the dispersing grenade launched into the atmosphere, a pyrotechnic charge;

forcing, by the activation of the pyrotechnic charge, a piston toward a bladder positioned within a shell and containing the taggant; and over-pressuring, by the piston, the taggant to burst the bladder, thereby dispersing the taggant over the target.

8. The method of claim 7, further comprising forcing the taggant through a plurality of apertures in a nose cone of the dispersing grenade.

9. A method for dispersing in an atmosphere a taggant over a target, comprising:

activating, in a dispersing grenade launched into the atmosphere, a pyrotechnic charge while the dispersing grenade is in the atmosphere;

forcing, by the activation of the pyrotechnic charge, a piston toward a bladder positioned within a shell and containing the taggant; and over-pressuring, by the piston, the taggant to burst the bladder, thereby dispersing the taggant over the target.

10. The method of claim 9, wherein the taggant comprises a liquid.

11. The method of claim 9, wherein the taggant is configured to mark an individual.

12. The method of claim 10, wherein the taggant is not visible to an unaided human eye in ambient lighting conditions, and is configured to fluoresce when exposed to radiation of a predetermined wavelength.

* * * * *